US008746524B2

(12) United States Patent
Richardson

(10) Patent No.: US 8,746,524 B2
(45) Date of Patent: Jun. 10, 2014

(54) VEST PACK

(76) Inventor: Raymond Kevin Richardson, Coronado, CA (US)

( * ) Notice: Subject to any disclaimer, the term of this patent is extended or adjusted under 35 U.S.C. 154(b) by 93 days.

(21) Appl. No.: 12/960,229

(22) Filed: Dec. 3, 2010

(65) Prior Publication Data

US 2011/0180579 A1 Jul. 28, 2011

Related U.S. Application Data

(63) Continuation-in-part of application No. 29/354,704, filed on Jan. 27, 2010, now Pat. No. Des. 640,009.

(51) Int. Cl.
*A45F 3/04* (2006.01)
*A41D 13/00* (2006.01)

(52) U.S. Cl.
CPC ..... *A45F 3/04* (2013.01); *A41D 13/0012* (2013.01); *A45F 2003/045* (2013.01)
USPC ..... 224/637; 224/645

(58) Field of Classification Search
CPC ..... A45F 3/04; A45F 3/14; A45C 11/08; A45C 11/30; A45C 11/38; A41D 13/0012
USPC ..... 224/637, 683, 587, 638, 645, 657, 259, 224/260, 262, 640, 648, 652, 653, 627, 224/650; 2/102
See application file for complete search history.

(56) References Cited

U.S. PATENT DOCUMENTS

| | | | | | |
|---|---|---|---|---|---|
| 1,797,359 | A * | 3/1931 | Meyers | 224/587 |
| 3,529,307 | A * | 9/1970 | Belson et al. | 2/94 |
| 4,106,121 | A * | 8/1978 | Belson | 2/102 |
| 4,658,442 | A * | 4/1987 | Tomlinson et al. | 2/94 |
| 5,195,187 | A * | 3/1993 | Yang | 2/102 |
| 5,327,811 | A * | 7/1994 | Price et al. | 2/2.5 |
| 6,108,816 | A * | 8/2000 | Bradley | 2/102 |
| 6,119,269 | A * | 9/2000 | Imler et al. | 2/94 |
| 2002/0152534 | A1 * | 10/2002 | Morrison | 2/102 |
| 2005/0098599 | A1 * | 5/2005 | von Foerster | 224/637 |

* cited by examiner

*Primary Examiner* — Adam Waggenspack

(57) ABSTRACT

A vest pack includes right and left pocket regions. Each pocket region is adapted for being positioned just below the respective right and left breast of a wearer. The vest pack further includes a zipper that connects the right and left pocket regions from approximately the sternum of the wearer to approximately a belt line of the wearer, and a pair of suspenders having a strap connected proximate each second pocket and adapted to be worn over the shoulders of the wearer. The vest pack further includes a back region comprising at least one elastic strap connecting opposing back sides of the right and left pocket regions, and to the straps of the pair of suspenders.

2 Claims, 3 Drawing Sheets

100

VEST PACK

CROSS REFERNCE TO RELATED APPLICATIONS

This application is a continuation-in-part of U.S. patent application Ser. No. 29/354,704, filed on Jan. 27, 2010, entitled "VEST PACK," the contents of which are hereby incorporated by refernce.

BACKGROUND

Conventional auxiliary packs, which include back-worn backpacks, front-back- or side-worn "fanny packs" and some vest packs, do not adequately distribute weight of items being carried within such packs. Further, most of these packs are very difficult to access when being work by a wearer. Further, conventional vest packs are not designed to be compatible or complementary with backpacks, especially when the backpacks are filled.

SUMMARY

This document presents a vest pack that is worn alone or is easily fitted under any existing backpack. The vest pack as described herein allows any user to wear the pack in conjunction with any form or type of backpack and redistribute personal items to the frontal or chest region, rather than carrying the full weight of carried items on the wearer's back. The vest pack in some implementations is worn underneath any backpack and targets specifically the area around the human rib cage, and does not interfere with the use of wearing a backpack. The goal is for the pack to be used in conjunction with a backpack and better redistribute total load capacity.

In accordance with some aspects, a vest pack includes right and left pocket regions. Each pocket region is adapted for being positioned just below the respective right and left breast of a wearer. The vest pack further includes a zipper that connects the right and left pocket regions from approximately the sternum of the wearer to approximately a belt line of the wearer, and a pair of suspenders having a strap connected proximate each second pocket and adapted to be worn over the shoulders of the wearer. The vest pack further includes a back region comprising at least one elastic strap connecting opposing back sides of the right and left pocket regions, and to the straps of the pair of suspenders.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
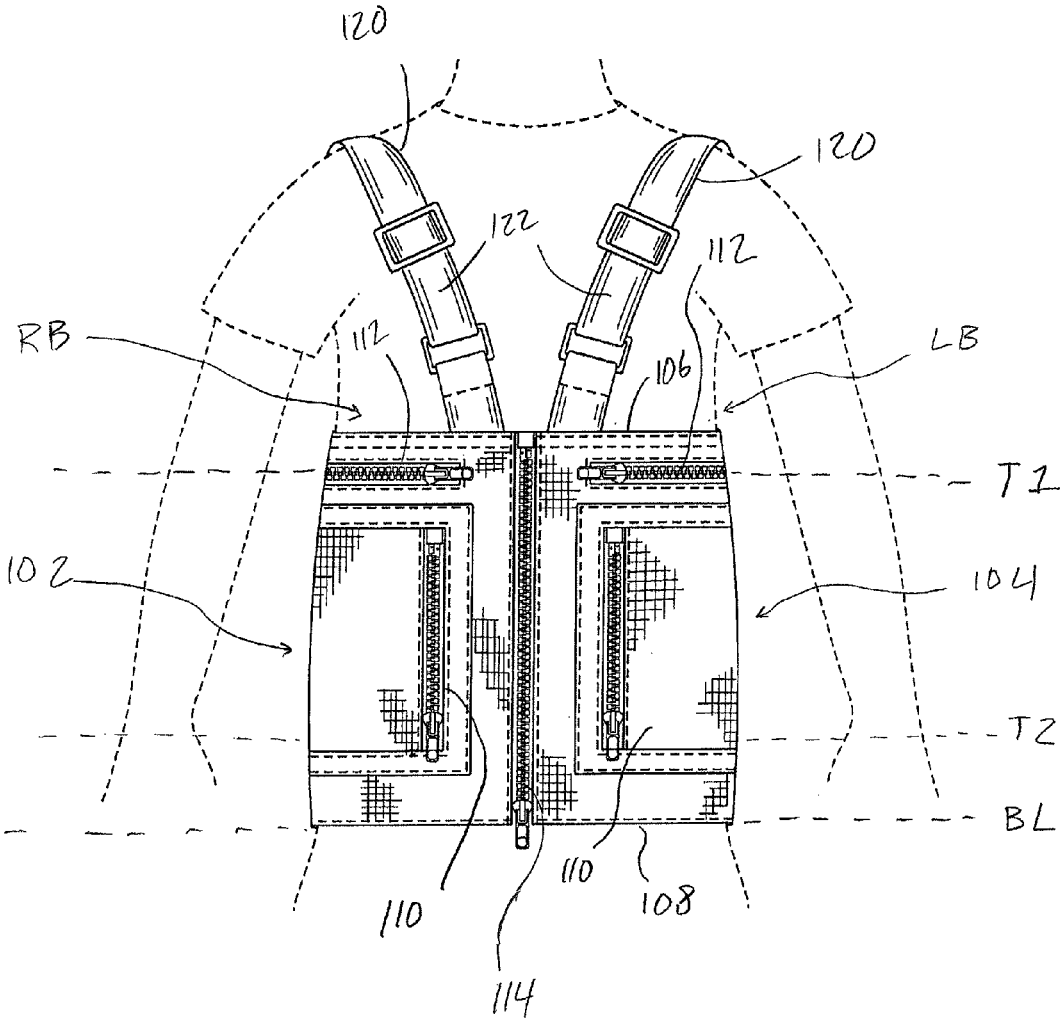
FIG. 1 is a front view of a vest pack worn by a wearer in accordance with some implementations.
Figure 3:
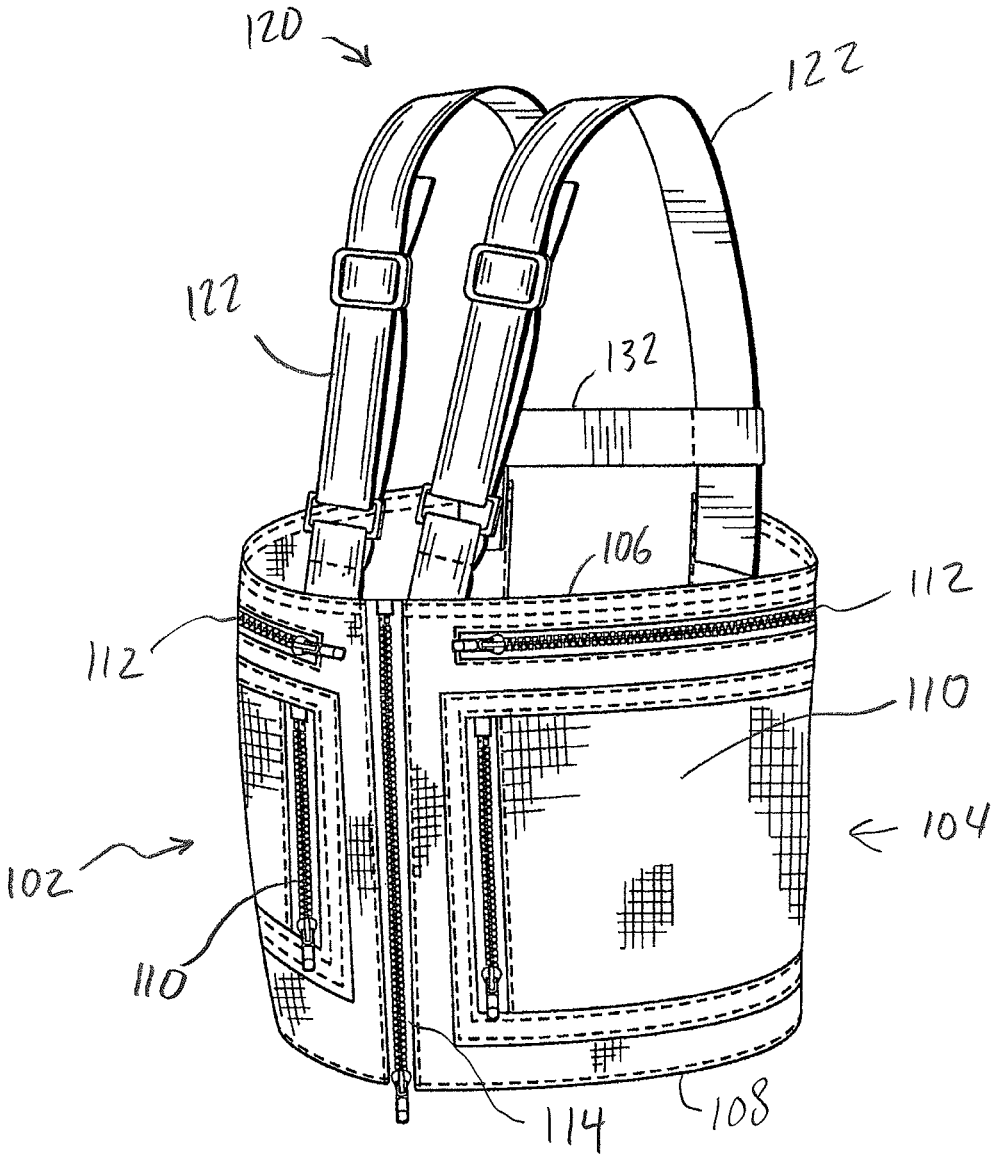
FIG. 3 is a perspective view of a vest pack.

This document describes a vest pack that has certain advantages over typical utility packs. As shown in FIGS. 1 and 3, a vest pack 100 has right and left pocket regions 102, 104. Each pocket region 102, 104 is adapted for being positioned just below the respective right and left breast (RB, LB, respectively) of a wearer. Each pocket region 102, 104 further includes a first pocket 110 having a substantially vertical (±30 degrees from vertical) zipper-enclosable opening, and a second pocket 112 positioned behind the first pocket and having a substantially horizontal (±30 degrees from horizontal) zipper-enclosable opening proximate to the top of the first pocket 110.

The right and left pocket regions 102, 104 can be connected together when the vest pack is worn by the wearer. In some implementations, a center zipper 114 connects the right and left pocket regions horizontally from the sternum of the wearer to approximately a belt line of the wearer. Although no particular directionality is required, in some implementations, the center zipper 114 connects top to bottom, such that the wearer can connect the right and left pocket regions with a single hand by directing the zipper tab downward. In other implementations right and left pocket regions 102, 104 can be connected together with buttons, snaps, magnets, hook-and-loop material, or other type of connecting mechanism.

In some preferred implementations, the first pocket 110 and second pocket 112 extend horizontally out from the center zipper 114 and around to approximately a center of a side abdominal region of the wearer just under the wearer's arms. The volume of each of the first and second pockets 110, 112 can range from 200 to 800 cubic inches, and preferably between 350 and 650 cubic inches. In some implementations, the first pockets 110 include folds that allow it to expand outward, away from the wearer's abdomen. Any of the pockets 110, 112 can include inner pockets, clips, holders, or other compartments, for holding any of a variety of tools and useful implements.

In some implementations, the vest pack 100 has a top edge 106 and a bottom edge 108, each defined by the right and left pocket regions 102, 104 when connected together. In these implementations, the right and left pocket regions 102, 104 are arranged so as to position the top edge 106 of the vest pack 100 above or near a transpyloric plane T1 of the abdomen of the wearer, and to position the bottom edge 108 of the vest pack 100 below or near a transtubercular plane T2 of the abdomen the wearer. In this arrangement, the wearer can easily access the first pocket 110 and/or second pocket 112 with either hand while the wearer is standing, sitting, or crouching.

Figure 2:
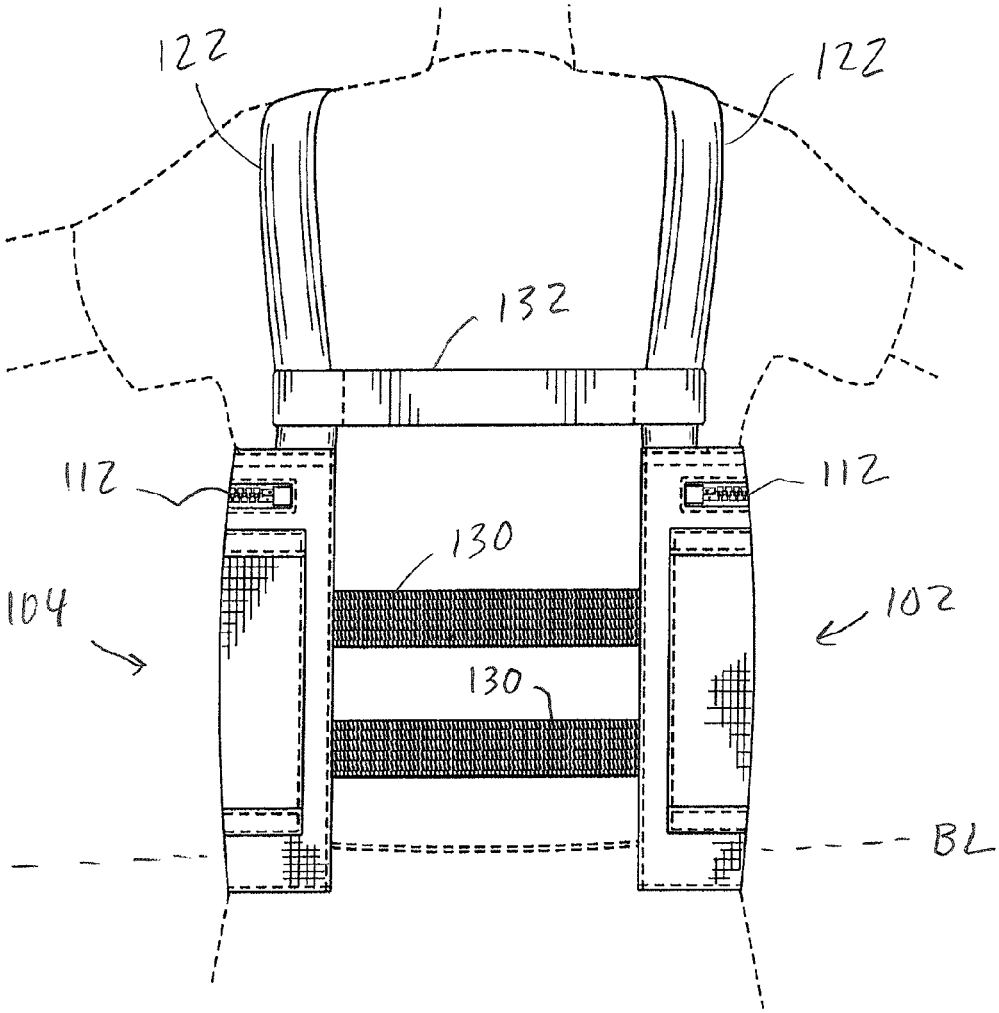
FIG. 2 is a back view of a vest pack worn by the wearer in accordance with some implementations.

The vest pack further includes a pair of suspenders 120 having a strap 122 connected proximate each second pocket 112 and adapted to be worn over the shoulders of the wearer. The pair of suspenders 120 aids in positioning the right and left pocket regions 102, 104 just below the respective right and left breast of a wearer, or over at least the lower ribs of the wearer. In some implementations, each of the pair of suspenders 120 includes an adjustable strap 122 that attaches to a respective pocket region proximate the second and travels approximately over the wearer's shoulder to a position at a back region (not shown) of the vest pack 100. Each strap 122 can include a buckle 124 to allow a length of the strap 122 to be adjustable, at As shown in FIG. 2, the back region includes at least one elastic strap 130 connecting opposing back sides of the right and left pocket regions 102, 104, and to the straps 122 of the pair of suspenders 120. The elastic strap(s) 130 can be augmented by an inelastic strap 132 that bridges between the straps 122 of the pair of suspenders 120, to arrange the straps 122 at a specific distance apart. The inelastic strap 132 may or may not be adjustable or configurable to a particular desired length. For example, the inelastic strap 132 can be fixed at 6 to 12 inches across. Or, in another example, the inelastic strap 132 can be adjustable to have a length between 6 to 12 inches.

The right and left pocket regions 102, 104, or any other component of the vest pack 100, can be formed of any durable material such as ballistic nylon, cotton, silk, or other material. The right and left pocket regions, 102, 104, as well as the vest pack in general, can also be formed of sail cloth, DYNEEMA®, parachute nylon, ripstop nylon, and CORDURA®, or any combination thereof.

Although a few embodiments have been described in detail above, other modifications are possible. Other embodiments may be within the scope of the following claims.

The invention claimed is:

1. A vest pack consisting of:

right and left pocket regions, each of the right and left pocket regions consisting of a first pocket having a substantially vertical zippered opening on a respective left and right side of the first pocket of the right and left pocket regions, and a second pocket positioned behind the first pocket to be closer to the body of the wearer, the second pocket having a substantially horizontal zippered opening proximate to a top edge of the first pocket of the right and left pocket regions, the right and left pocket regions being formed of ballistic nylon;

a zipper that connects the right and left pocket regions from approximately the sternum of the wearer to approximately a belt line of the wearer;

a pair of suspenders, each of the pair of suspenders having a strap connected to a respective right or left pocket region proximate the second pocket and adapted to be worn over the shoulders of the wearer, each of the straps of the pair of suspenders having a buckle to adjust a length of the strap to position the right and left pocket regions below the respective right and left breast and above the belt line of the wearer;

at least one elastic connector connecting opposing back sides of the right and left pocket regions, the opposing back sides of the right and left pocket regions being connected to the straps of the pair of suspenders; and at least one inelastic connector that connects the straps of the pair of suspenders at a position above the opposing back sides of the right and left pocket regions.

2. The vest pack in accordance with claim 1, wherein each of the right and left pocket regions is formed of ballistic nylon.

* * * * *